US010808331B2

(12) United States Patent
Shih et al.

(10) Patent No.: US 10,808,331 B2
(45) Date of Patent: Oct. 20, 2020

(54) ELECTROPLATING SYSTEM AND PRESSURE DEVICE THEREOF

(71) Applicant: CHIPBOND TECHNOLOGY CORPORATION, Hsinchu (TW)

(72) Inventors: Cheng-Hung Shih, Changhua County (TW); Tsuo-Yun Chu, Hsinchu County (TW); Xin-Wei Lo, Pingtung County (TW); Nian-Cih Yang, Hsinchu County (TW)

(73) Assignee: CHIPBOND TECHNOLOGY CORPORATION, Hsinchu (TW)

( * ) Notice: Subject to any disclaimer, the term of this patent is extended or adjusted under 35 U.S.C. 154(b) by 430 days.

(21) Appl. No.: 15/867,878

(22) Filed: Jan. 11, 2018

(65) Prior Publication Data

US 2019/0186037 A1 Jun. 20, 2019

(30) Foreign Application Priority Data

Dec. 15, 2017 (TW) ..... 106144223 A

(51) Int. Cl.
*C25D 21/04* (2006.01)
*C25D 17/00* (2006.01)
(Continued)

(52) U.S. Cl.
CPC ..... *C25D 21/04* (2013.01); *C25D 5/08* (2013.01); *C25D 17/001* (2013.01);
(Continued)

(58) Field of Classification Search
CPC . C25D 3/38; C25D 5/026; C25D 5/08; C25D 21/10; C25D 21/14; C25D 17/001; C25D 17/008; C25D 17/06
See application file for complete search history.

(56) References Cited

U.S. PATENT DOCUMENTS

2004/0084318 A1 5/2004 Cohen
2004/0094427 A1 5/2004 Economikos et al.
(Continued)

FOREIGN PATENT DOCUMENTS

CN 1742119 A 3/2006
CN 102191521 A 9/2011
(Continued)

OTHER PUBLICATIONS

Korean Notice of Allowance dated Jun. 18, 2019 for Korean Patent Application No. 10-2018-0004961, 2 pages.
(Continued)

*Primary Examiner* — Ciel P Contreras
(74) *Attorney, Agent, or Firm* — Demian K. Jackson; Jackson IPG PLLC

(57) ABSTRACT

An electroplating system for depositing a plating material on an object includes a pressure device and an anode element. The pressure device includes a lid having first and second through holes and a base having a chamber, conduction holes and third through holes located in the chamber. Each of the conduction tubes includes a conduction hole connecting to one of the third through holes. The lid covers the chamber, the first through holes communicate with the chamber for spraying an electroplating solution toward the object and the second through holes reveal the conduction holes. A passage of electric force line is formed in the connected holes and the third through holes filled with the electroplating solution, and the anode element is located outside the passage of electric force line. The electroplating system can prevent defective plating and enhance plating efficiency.

19 Claims, 6 Drawing Sheets

(51) Int. Cl.

| | |
|---|---|
| ***C25D 21/10*** | (2006.01) |
| ***C25D 17/06*** | (2006.01) |
| ***C25D 5/08*** | (2006.01) |

(52) U.S. Cl.

CPC ..... *C25D 17/008* (2013.01); *C25D 17/06* (2013.01); *C25D 21/10* (2013.01)

(56) References Cited

U.S. PATENT DOCUMENTS

| | | | | |
|---|---|---|---|---|
| 2005/0051437 | A1 | 3/2005 | Kurashina et al. | |
| 2011/0056840 | A1* | 3/2011 | Isono ..... | C25D 3/38 205/296 |
| 2016/0194776 | A1 | 7/2016 | Weinhold et al. | |

FOREIGN PATENT DOCUMENTS

| | | | |
|---|---|---|---|
| CN | 103025922 | A | 4/2013 |
| CN | 106609386 | A | 5/2017 |
| CN | 206266725 | U | 6/2017 |
| JP | 2004-311919 | A | 11/2004 |
| JP | 2004-359994 | A | 12/2004 |
| JP | 2011-241417 | A | 12/2011 |
| KR | 10-1226663 | B1 | 1/2013 |
| KR | 20-2014-0004836 | U | 8/2014 |

OTHER PUBLICATIONS

Taiwanese Notice of Allowance dated Apr. 30, 2019 for Taiwanese Patent Application No. 106144223, 3 pages.

European Search Report dated Jul. 19, 2018 for European Patent Application No. 18152963.7, 9 pages.

Taiwanese Office Action dated Apr. 26, 2018 for Taiwanese Patent Application No. 106144223, 4 pages.

Chinese Office Action dated Jan. 21, 2020 for Chinese Patent Application No. 201711436261.8, 6 pages.

Japanese Notice of Allowance dated Jun. 21, 2019 for Japanese Patent Application No. 2018-017037, 3 pages.

Japanese Office Action dated Apr. 23, 2019 for Japanese Patent Application No. 2018-017037, 3 pages.

* cited by examiner

ELECTROPLATING SYSTEM AND PRESSURE DEVICE THEREOF

FIELD OF THE INVENTION

This invention relates to an electroplating system and its pressure device. The electroplating system placed in an electroplating tank filling with plating solution is adapted to deposit a plating material on an object.

BACKGROUND OF THE INVENTION

In conventional electroplating process, a plating object and a metal anode element are placed in an electroplating tank and electrically connected to a cathode and an anode of a power supply, respectively. An electroplating solution filling in the electroplating tank is provided to deposit a plating material onto the plating object. For instance, the plating object is a wafer or a circuit board, the metal anode element is a copper sheet and the electroplating solution is $CuSO_4$, and a copper layer or a copper wire can be formed on the surface of the plating object when powered on.

However, the plating rate of the conventional electroplating process is slower, and bubbles and/or impurities may remain in fine-pitch wires or blind holes of the wafer and circuit board during the conventional electroplating process, so plating defect may occur in the fine-pitch wires or blind holes.

SUMMARY

The object of the present invention is to prevent plating defect and enhance plating efficiency.

The electroplating system of the present invention is adapted to deposit a plating material on an object when placed in an electroplating tank with an electroplating solution. The electroplating system includes a pressure device and an anode element. The pressure device includes a lid and a base. The lid has a first surface, a second surface, first through holes and second through holes. The first surface faces toward the object, and the first and second surfaces are communicated with each other through the first and second through holes. The base has a third surface, a chamber recessed on the third surface, conduction tubes and third through holes. The third through holes are formed in the chamber and penetrate through the base. Each of the conduction tubes is positioned in the chamber and includes a conduction hole, and each of the conduction holes connects to one of the third through holes. The lid covers an opening of the chamber, the first through holes communicate with the chamber, and each of the second through holes reveals one of the conduction holes. When the electroplating solution is filled in the chamber, the electroplating solution in the chamber is sprayed toward the object through the first through holes. When the electroplating solution is filled in the conduction holes and the third through holes, the conduction holes and the third through hole connected with each other become a passage of electric force line. The anode element is disposed outside the pressure device, the object is located outside a first end of the passage of electric force line and the anode element is located outside a second end of the passage of electric force line.

The electroplating solution, filled and pressed in the chamber, can spray toward the object through the first through holes, and the electroplating solution spraying from the chamber can wash the bubbles and/or impurities remained on the object to prevent plating defect and enhance plating efficiency. Furthermore, the passage of electric force line formed in the conduction holes and the third through holes provides a benefit for the deposition of the plating material on the object.

DETAILED DESCRIPTION OF THE INVENTION

Figure 1:
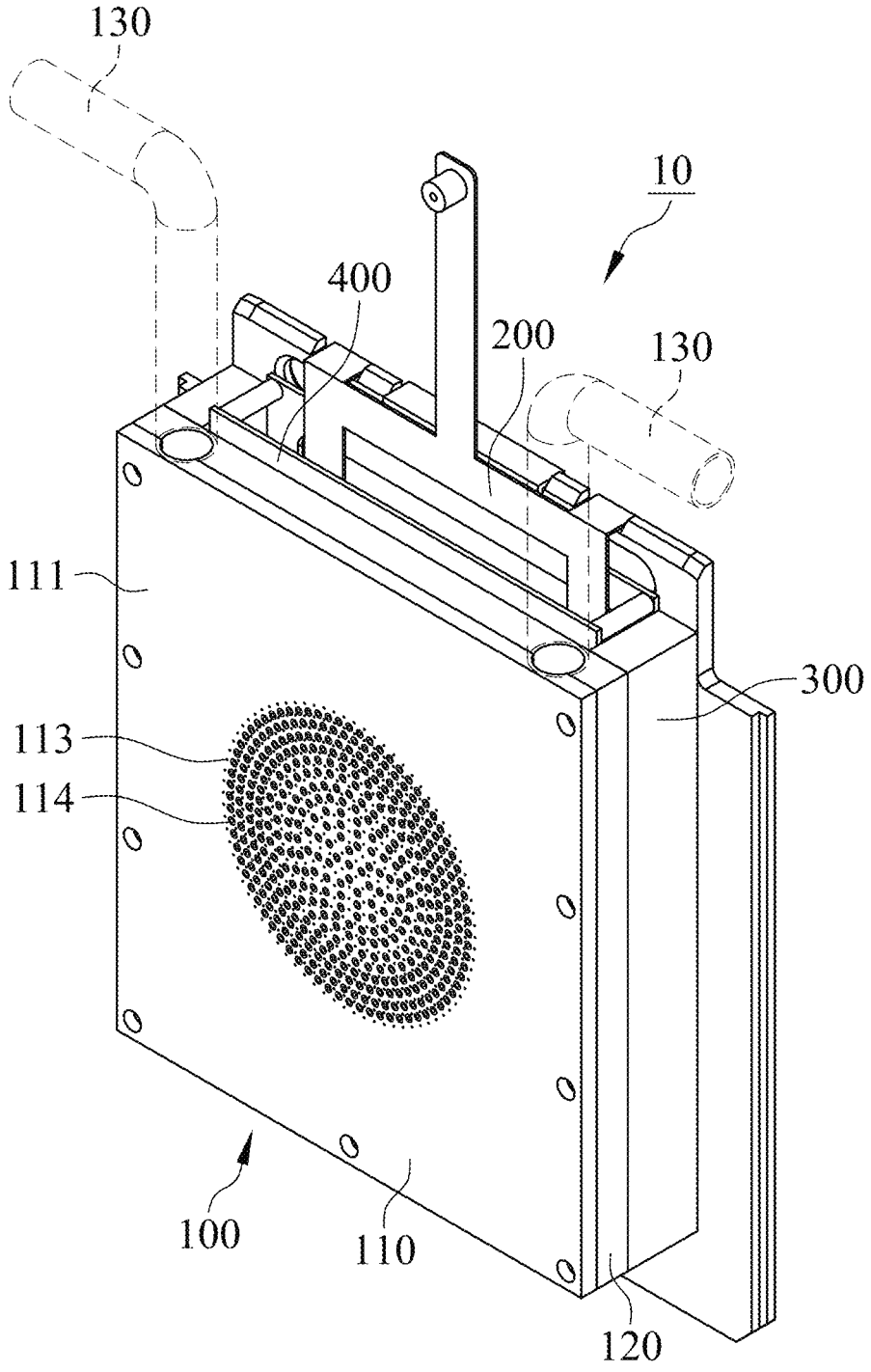
FIG. 1 is a perspective assembly diagram illustrating an electroplating system of the present invention.
Figure 2:
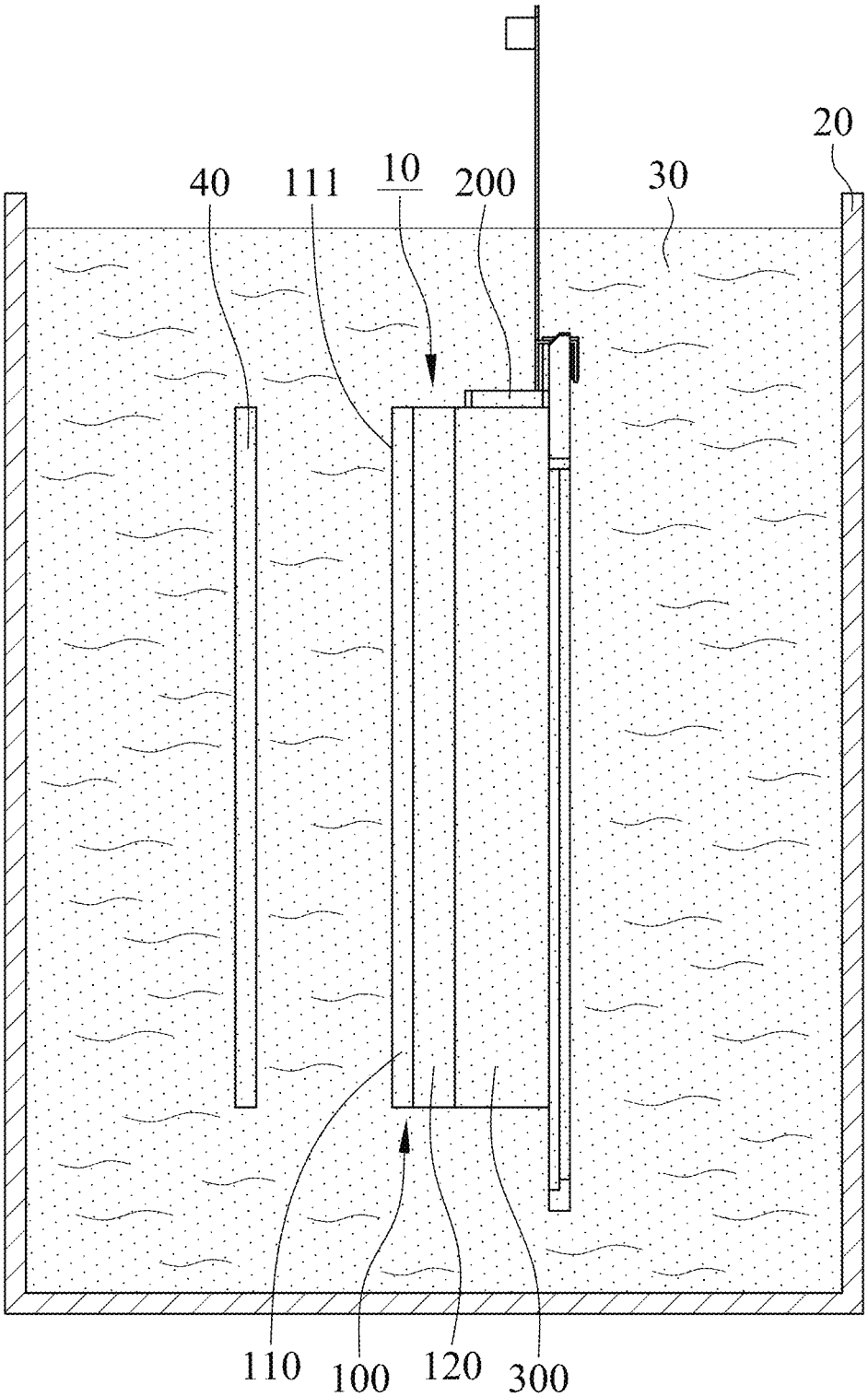
FIG. 2 is a schematic diagram illustrating the electroplating system of the present invention and an object which are placed in an electroplating tank.

With reference to FIGS. 1 and 2, an electroplating system 10 of the present invention can be placed in an electroplating tank 20 with an electroplating solution 30 to deposit a plating material on an object 40. The object 40 is, but not limited to, a wafer or a circuit board.

Figure 3:
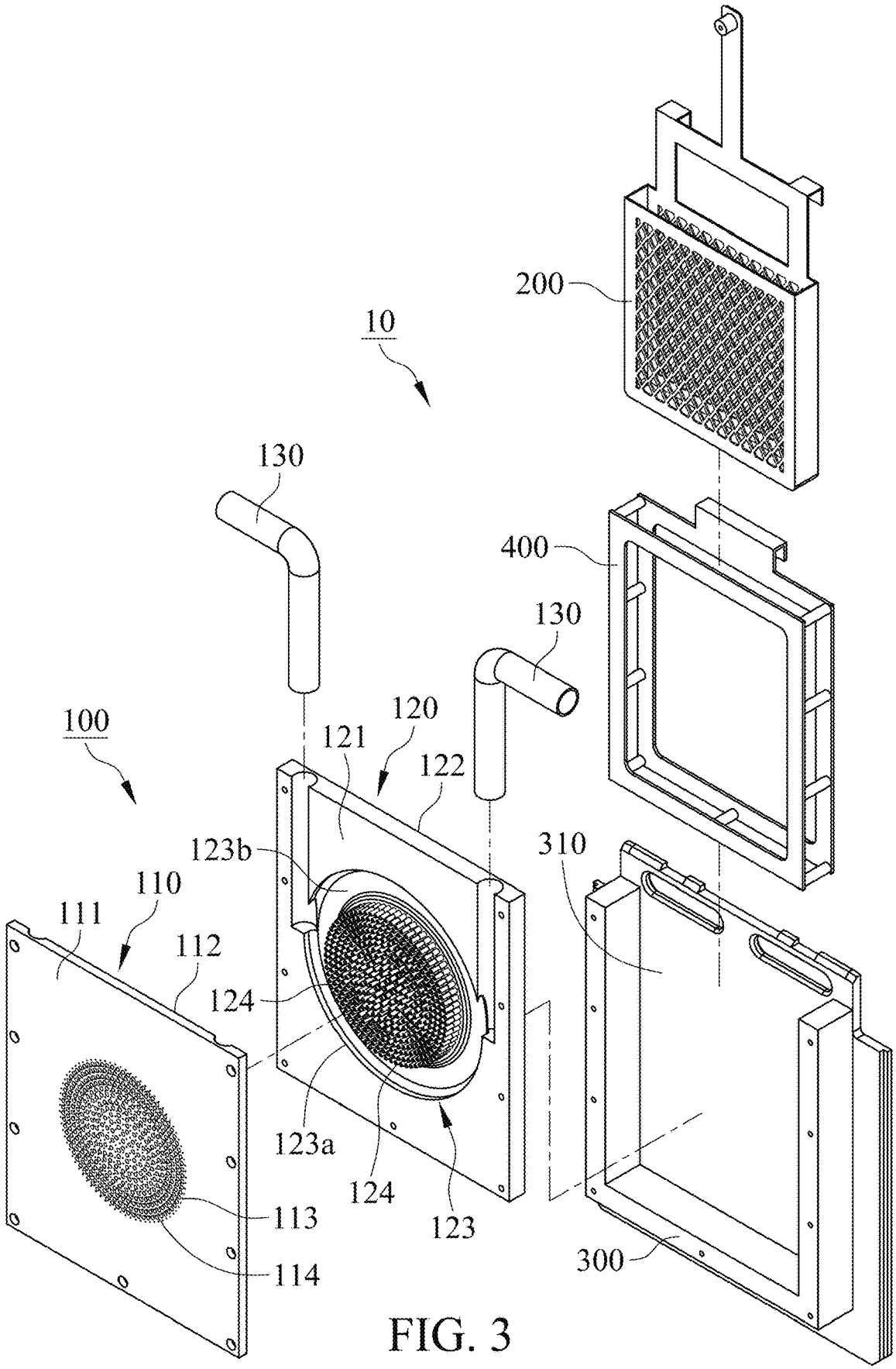
FIG. 3 is a perspective exploded diagram illustrating the electroplating system of the present invention.

With reference to FIGS. 1 to 3, the electroplating system 10 includes a pressure device 100 and an anode element 200 positioned outside the pressure device 100. Preferably, the anode element 200 is a titanium basket which can accommodate a metal piece.

With reference to FIGS. 1 to 4, the electroplating system 10 further includes a carrier 300 and the pressure device 100 is connected to the carrier 300 in this embodiment. The carrier 300 has an accommodation space 310 where the anode element 200 is placed. Preferably, the electroplating system 10 further includes a frame 400 which is positioned in the accommodation space 310, and the anode element 200 is placed in the frame 400. Furthermore, the anode element 200 (e.g. titanium basket) and/or the frame 400 are replaceable.

Figure 4:
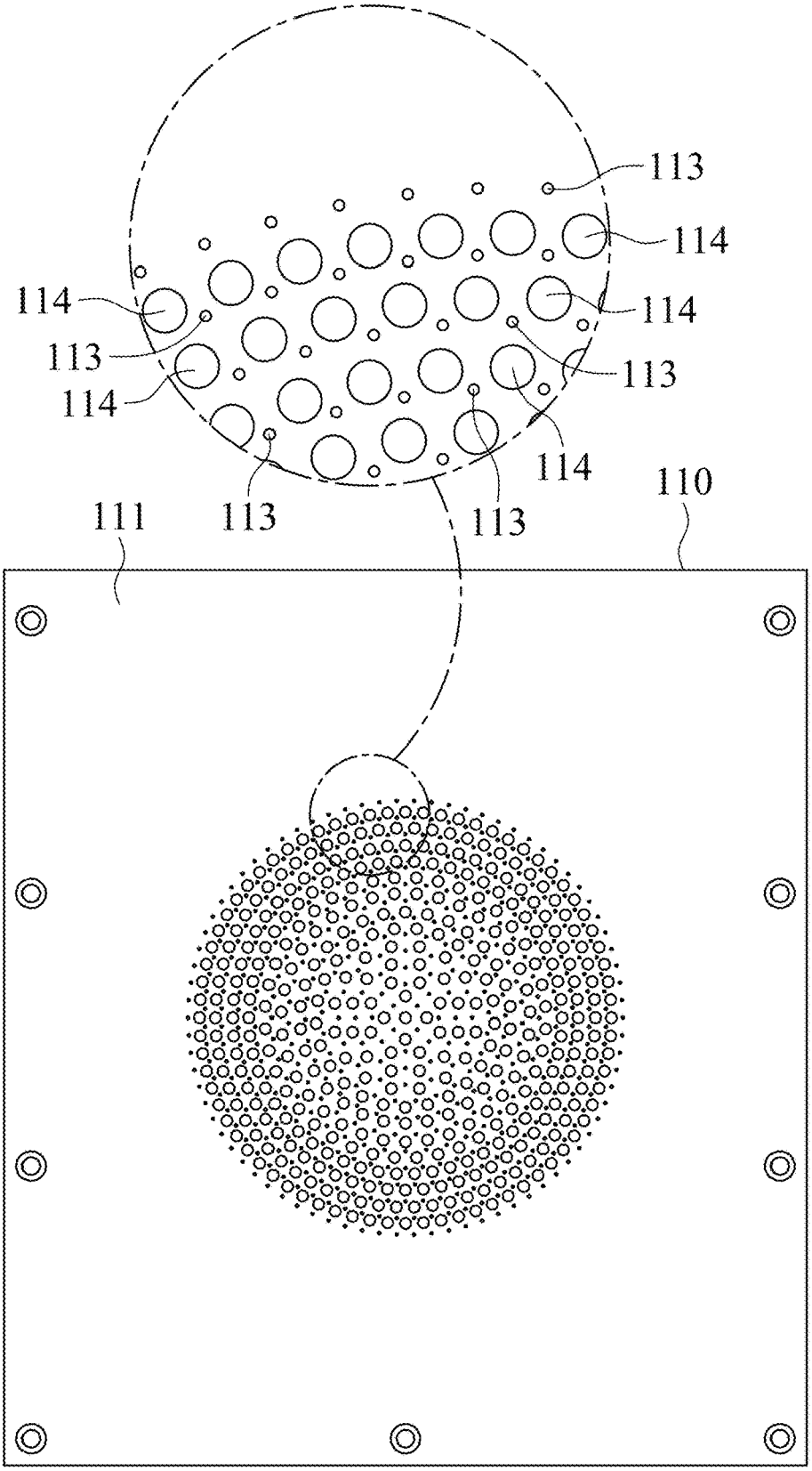
FIG. 4 is a front-side view diagram illustrating a lid of a pressure device of the present invention.
Figure 5:
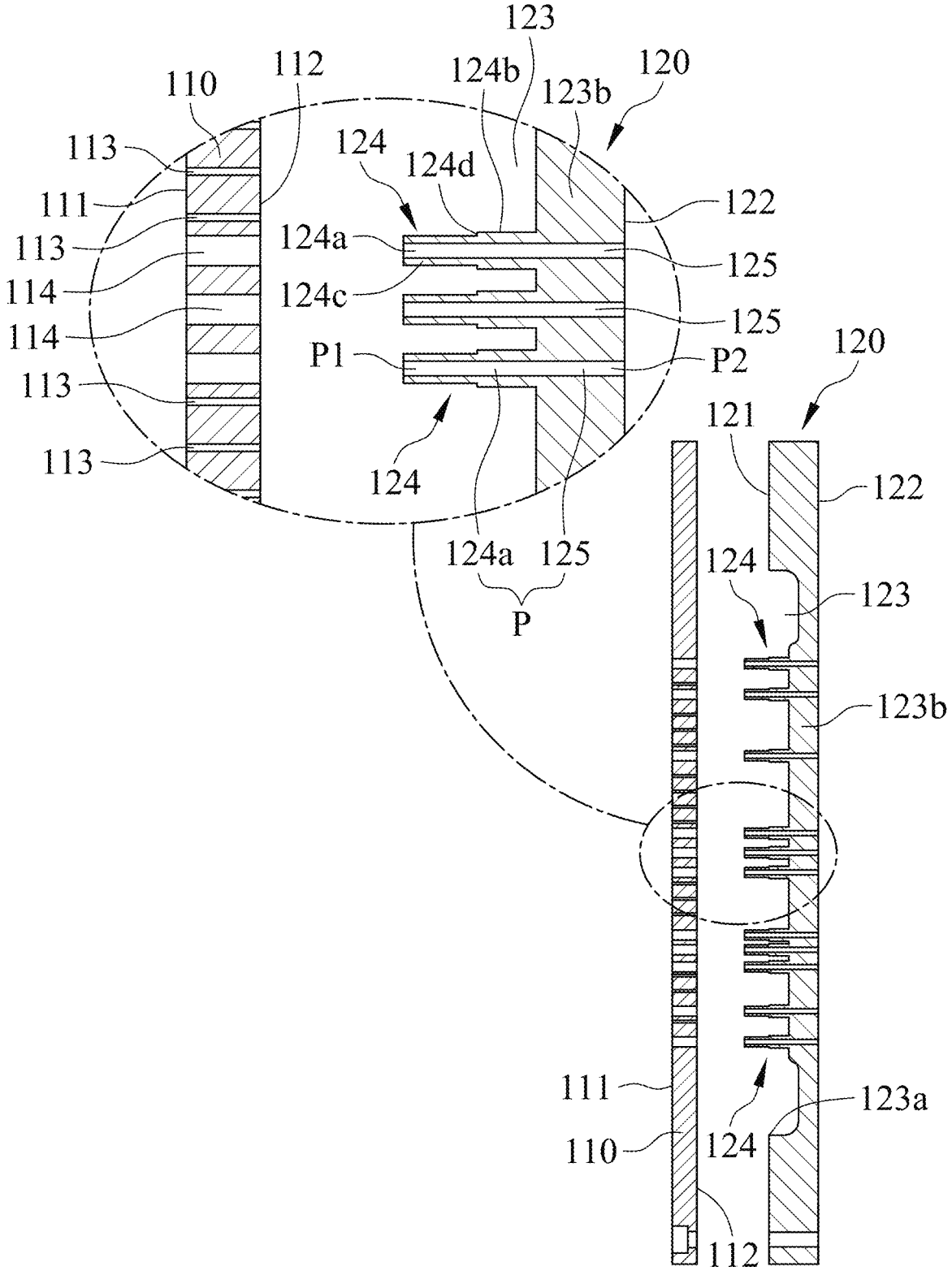
FIG. 5 is a cross-section view diagram illustrating the pressure device of the present invention.

With reference to FIGS. 2 to 6, the pressure device 100 includes a lid 110 and a base 120. The lid 110 has a first surface 111, a second surface 112, first through holes 113 and second through holes 114. The first surface 111 faces toward the object 40 when the electroplating system 10 is placed in the electroplating tank 20 filling with the electroplating solution 30. With reference to FIGS. 3 to 5, the first and second surfaces 111 and 112 are communicated with each other via the first and second through holes 113 and 114, in other words, the first and second through holes 113 and 114 penetrate through the lid 110. Preferably, the first and second through holes 113 and 114 are aligned radially on the lid 110, and the first through holes 113 have a diameter equal to or smaller than that of the second through holes 114.

With reference to FIGS. 3 and 5, the base 120 includes a third surface 121, a fourth surface 122, a chamber 123 recessed on the third surface 121, conduction tubes 124 and third through holes 125. The third through holes 125 are formed in the chamber 123 and penetrate through the base 120. There are an opening **123*a* and a bottom 123*b* in the chamber 123, and the opening 123*a* reveals the bottom 123*b*. In this embodiment, the third through holes 125 are formed on the bottom 123*b* and penetrate through the fourth surface 122. The conduction tubes 124 are located in the chamber 123 and each includes a conduction hole 124***a*. Preferably, the diameter of the first through holes 113 is equal to or smaller than that of the conduction holes 124*a*, and each of the conduction holes 124*a* is connected with one of the third through holes 125.

With reference to FIGS. 3 and 5, each of the conduction tubes 124 in this embodiment includes a basal portion 124*b* and a connecting portion 124*c*, and the conduction hole 124*a* is formed in the basal portion 124*b* and the connecting portion 124*c*. The basal portion 124*b* is connected to the bottom 123*b* of the chamber 123, and the connecting portion 124*c* is protruded from the third surface 121.

Figure 6:
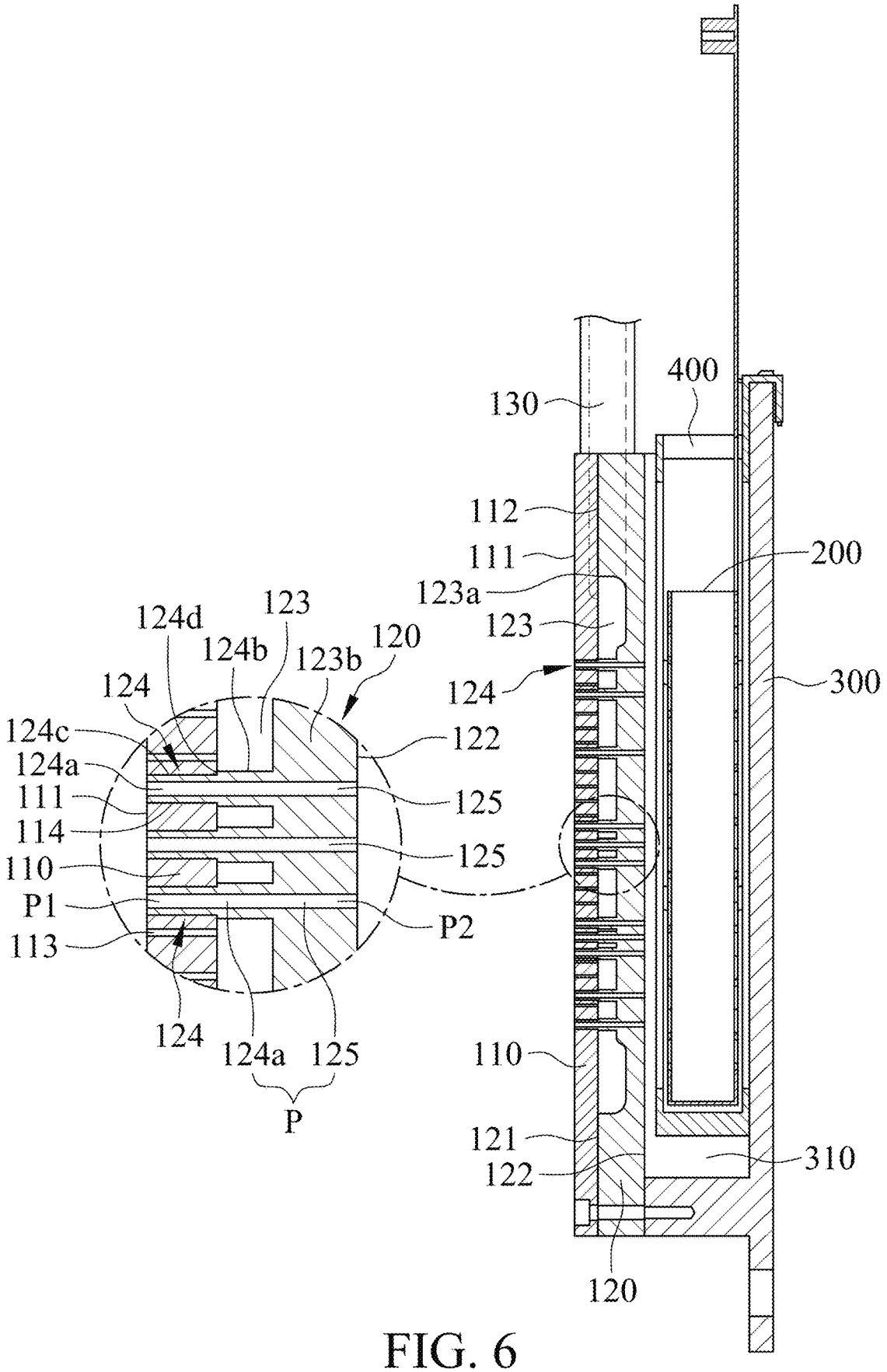
FIG. 6 is a cross-section view diagram illustrating the electroplating system of the present invention.

With reference to FIGS. 3, 5 and 6, the lid 110 covers the opening 123*a*, the first through holes 113 communicate with the chamber 123 and the second through holes 114 reveal the conduction holes 124*a*. In this embodiment, the connecting portion 124*c* of each of the conduction tubes 124 is inserted into one of the second through holes 114, and the first surface 111 of the lid 110 and the fourth surface 122 of the base 120 are communicated with each other through the conduction holes 124*a* and the third through holes 125 which are connected together. Moreover, each of the conduction tubes 124 in this embodiment further includes a supporting portion 124*d* located between the basal portion 124*b* and the connecting portion 124*c*. The supporting portion 124*d* is adapted to support the lid 110 covering the opening 123*a* in order to prevent the lid 110 from distorting.

With reference to FIGS. 3 and 6, the pressure device 100 in this embodiment further includes at least one feeding pipe 130 which is designed to communicate with the chamber 123. When the lid 110 covers the opening 123*a* of the chamber 123, the feeding pipe 130 is provided to supply the electroplating solution 30 to the chamber 123. Preferably, a motor is utilized to deliver the electroplating solution 30 in the electroplating tank 20 to the chamber 123 through the feeding pipe 130.

With reference to FIGS. 4 to 6, owing to the connecting portion 124*c* of each of the conduction tubes 124 is inserted into the second through hole 114 when the lid 110 covers the opening 123*a* of the chamber 123, the electroplating solution delivered to the chamber 123 by the feeding pipe 130 can be sprayed through the first through holes 113. The higher the flow quantity or flow rate of the electroplating solution delivered to the chamber 123 through the feeding pipe 130, the higher impact the electroplating solution 30 sprayed from the first through holes 113. Besides, the smaller the diameter of the first through holes 113, the higher impact the electroplating solution 30 sprayed from the first through holes 113.

With reference to FIGS. 2 and 6, when the electroplating system 10 and the object 40 are placed in the electroplating tank 20 with the electroplating solution 30 and the conduction holes 124*a* and the third through holes 125 are filled with the electroplating solution, the object 40 and the anode element 200 can be electrically connected to a cathode and a anode of a DC power supply respectively, allow the conduction holes 124*a* and the third through holes 125 connected with each other to become a passage of electric force line P. The object 40 is located outside a first end P1 of the passage of electric force line P and the anode element 200 is located outside a second end P2 of the passage of electric force line P for the deposition of the plating material on the object 40. Otherwise, when the electroplating solution 30 is delivered to the chamber 123 via the feeding pipe 130, the electroplating solution filling in the chamber 123 can be sprayed toward the object 40 through the first through hole 113 to enhance the electroplating efficiency. And the electroplating solution 30 sprayed from the first through holes 113 also can wash the bubbles and/or impurities remained on the object 40 so as to prevent defective plating.

While this invention has been particularly illustrated and described in detail with respect to the preferred embodiments thereof, it will be clearly understood by those skilled in the art that is not limited to the specific features shown and described and various modified and changed in form and details may be made without departing from the spirit and scope of this invention.

What is claimed is:

1. A pressure device of an electroplating system, the electroplating system is adapted to deposit a plating material on an object when placed in an electroplating tank with an electroplating solution, the pressure device comprising:

a lid having a first surface, a second surface, a plurality of first through holes and a plurality of second through holes, the first surface faces toward the object, the first and second surfaces are communicated with each other through the plurality of first and second through holes; and a base having a third surface, a fourth surface, a chamber recessed on the third surface, a plurality of conduction tubes and a plurality of third through holes, the plurality of third through holes are formed in the chamber and penetrate through the fourth surface, the plurality of conduction tubes are positioned in the chamber and each includes a conduction hole, each of the plurality of conduction holes connects to one of the plurality of third through holes, wherein the lid covers an opening of the chamber, the plurality of first through holes communicate with the chamber, each of the plurality of second through holes reveals one of the plurality of conduction holes, and the electroplating solution filled in the chamber is able to be sprayed toward the object through the plurality of first through holes, and wherein the plurality of conduction holes and the plurality of third through holes connected with each other become a passage of electric force line when the electroplating solution is filled in the plurality of conduction holes and the plurality of third through holes.

2. The pressure device in accordance with claim 1, wherein each of the plurality of conduction tubes includes a basal portion and a connecting portion, each of the plurality of conduction holes is formed in the basal portion and the connecting portion, the basal portion is connected to a bottom of the chamber and the plurality of third through holes are formed on the bottom, each of the connecting portions is protruded from the third surface and is inserted into one of the plurality of second through holes when the lid covers the opening.

3. The pressure device in accordance with claim 2, wherein each of the plurality of conduction tubes further includes a supporting portion located between the basal portion and the connecting portion for supporting the lid.

4. The pressure device in accordance with claim 1, wherein the plurality of first through holes have a diameter which is equal to or smaller than that of the plurality of second through holes.

5. The pressure device in accordance with claim 1, wherein the plurality of first through holes have a diameter which is equal to or smaller than that of the plurality of conduction holes.

6. The pressure device in accordance with claim 1 further comprising at least one feeding pipe, wherein the feeding pipe communicates with the chamber for delivering the electroplating solution to the chamber.

7. The pressure device in accordance with claim 1, wherein the plurality of first through holes are aligned radially on the lid.

8. The pressure device in accordance with claim 1, wherein the plurality of second through holes are aligned radially on the lid.

9. An electroplating system adapted to deposit a plating material on an object when placed in an electroplating tank with an electroplating solution, comprising:

a pressure device including a lid and a base, the lid has a first surface, a second surface, a plurality of first through holes and a plurality of second through holes, the first surface faces toward the object, the first and second surfaces are communicated with each other through the plurality of first and second through holes, the base has a third surface, a fourth surface, a chamber recessed on the third surface, a plurality of conduction tubes and a plurality of third through holes, the plurality of third through holes are formed in the chamber and penetrate through the fourth surface, the plurality of conduction tubes are positioned in the chamber and each includes a conduction hole, each of the plurality of conduction holes connects to one of the plurality of third through holes, wherein the lid covers an opening of the chamber, the plurality of first through holes communicate with the chamber, each of the plurality of second through holes reveals one of the plurality of conduction holes, and the electroplating solution filled in the chamber is able to be sprayed toward the object through the plurality of first through holes, and wherein the plurality of conduction holes and the plurality of third through holes connected with each other become a passage of electric force line when the electroplating solution is filled in the plurality of conduction holes and the plurality of third through holes; and an anode element disposed outside the pressure device, the object is located outside a first end of the passage of electric force line and the anode element is located outside a second end of the passage of electric force line.

10. The electroplating system in accordance with claim 9, wherein the anode element is a titanium basket.

11. The electroplating system in accordance with claim 9 further comprising a carrier having an accommodation space, wherein the pressure device is connected to the carrier and the anode element is placed in the accommodation space.

12. The electroplating system in accordance with claim 9 further comprising a carrier and a frame, wherein the pressure device is connected to the carrier having an accommodation space, the anode element is placed in the frame, and the frame is placed in the accommodation space.

13. The electroplating system in accordance with claim 9, wherein each of the plurality of conduction tubes includes a basal portion and a connecting portion, each of the plurality of conduction holes is formed in the basal portion and the connecting portion, the basal portion is connected to a bottom of the chamber and the plurality of third through holes are formed on the bottom, each of the connecting portions is protruded from the third surface and is inserted into one of the plurality of second through holes when the lid covers the opening.

14. The electroplating system in accordance with claim 13, wherein each of the plurality of conduction tubes further includes a supporting portion located between the basal portion and the connecting portion for supporting the lid.

15. The electroplating system in accordance with claim 9, wherein the plurality of first through holes have a diameter which is equal to or smaller than that of the plurality of second through holes.

16. The electroplating system in accordance with claim 9, wherein the plurality of first through holes have a diameter which is equal to or smaller than that of the plurality of conduction holes.

17. The electroplating system in accordance with claim 9, wherein the pressure device further includes at least one feeding pipe, the feeding pipe communicates with the chamber for delivering the electroplating solution to the chamber.

18. The electroplating system in accordance with claim 9, wherein the plurality of first through holes are aligned radially on the lid.

19. The electroplating system in accordance with claim 9, wherein the plurality of second through holes are aligned radially on the lid.

* * * * *